US010036230B2

(12) United States Patent
Hardesty

(10) Patent No.: US 10,036,230 B2
(45) Date of Patent: Jul. 31, 2018

(54) HYDRAULIC FLOW RESTRICTION TUBE TIME DELAY SYSTEM AND METHOD

(71) Applicant: GEODynamics, Inc., Millsap, TX (US)

(72) Inventor: John T Hardesty, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 15/016,009

(22) Filed: Feb. 4, 2016

(65) Prior Publication Data

US 2016/0153262 A1 Jun. 2, 2016

Related U.S. Application Data

(63) Continuation-in-part of application No. 14/685,176, filed on Apr. 13, 2015, now Pat. No. 9,273,535.

(60) Provisional application No. 62/081,196, filed on Nov. 18, 2014.

(51) Int. Cl.
*E21B 34/10* (2006.01)

(52) U.S. Cl.
CPC ..... *E21B 34/108* (2013.01)

(58) Field of Classification Search
CPC ..... E21B 34/108
See application file for complete search history.

(56) References Cited

U.S. PATENT DOCUMENTS 3,780,809 A 12/1973 Ayers et al.
3,886,969 A 6/1975 Shira et al.
4,083,409 A 4/1978 Barrington
4,113,012 A 9/1978 Evans et al.
4,691,779 A 9/1987 McMahan et al.
4,809,778 A 3/1989 Johnson
4,957,167 A 9/1990 Schultz
5,058,674 A 10/1991 Schultz et al.
5,103,906 A 4/1992 Schultz et al.
(Continued)

FOREIGN PATENT DOCUMENTS

WO WO2013135861 * 9/2013 ..... E21B 47/10

OTHER PUBLICATIONS

ISA/US, International Search Report and Written Opinion for PCT/US2015/029982 dated Aug. 26, 2015.
(Continued)

*Primary Examiner* — Nicole Coy
(74) *Attorney, Agent, or Firm* — Patent Portfolio Builders PLLC

(57) ABSTRACT

A hydraulic time delay system and method in a wellbore tool is disclosed. The system/method includes an actuation mechanism which allows pressure to act on a functional piston in the wellbore tool. The movement of the piston is restrained by a partially or filled reservoir which is allowed to exhaust through a flow restriction element. The restriction element comprises standard metal tubing with a known inner diameter and is cut to an exact length as predicted by fluid dynamic modeling. A time delay and rate of piston movement desired for the downhole tool, between a trigger event such as pressure and a functional event, can be tuned with parameters that include the length and diameter of the tubing, reservoir fluid viscosity, porous material with permeability in the tube, and number of tubes in parallel.

26 Claims, 9 Drawing Sheets

*FIG. 9*

(56) References Cited

U.S. PATENT DOCUMENTS

| | | | |
|---|---|---|---|
| 5,238,070 | A | 8/1993 | Schultz et al. |
| 5,887,654 | A | 3/1999 | Edwards et al. |
| 5,950,733 | A | 9/1999 | Patel |
| 6,820,697 | B1 * | 11/2004 | Churchill |
| 8,474,535 | B2 | 7/2013 | Richards et al. |
| 8,807,215 | B2 | 8/2014 | Holderman et al. |
| 9,273,535 | B1 | 3/2016 | Hardesty |
| 2006/0096786 | A1 | 5/2006 | Wells |
| 2014/0251620 | A1 | 9/2014 | George et al. |
| 2014/0299330 | A1 | 10/2014 | Fripp et al. |

OTHER PUBLICATIONS

The Lee Company, Technical Hydraulic Handbook, 11th Edition, 2009, pp. B0-B7, online catalog retrieved on Aug. 6, 2015 from http://www.theleeco.com/resources/pdf/THHcd09.pdf.

European Patent Office, European Search Report for EP 16164638, dated Oct. 17, 2016.

* cited by examiner

HYDRAULIC FLOW RESTRICTION TUBE TIME DELAY SYSTEM AND METHOD

CROSS REFERENCE TO RELATED APPLICATIONS

This application is a continuation-in-part of application Ser. No. 14/685,176, filed Apr. 13, 2015, which claims the benefit of U.S. Provisional Application No. 62/081,196, filed Nov. 18, 2014, the disclosures of which are fully incorporated herein by reference.

FIELD OF THE INVENTION

The present invention generally relates to downhole wellbore tools. Specifically, the invention attempts to hydraulically control a rate of travel of a piston with porous restriction tubing with a known inner diameter permitting a known time delay between a trigger event and a functional event.

PRIOR ART AND BACKGROUND OF THE INVENTION

Prior Art Background

In oil and gas extraction applications, there is a need to have a certain length of time delay between pressure triggered events such that the system can be tested at a pressure before the next event could proceed. This system cannot be controlled with any other means besides the application of pressure. Prior art systems of fluid restriction use a complex system of microscopic passages that meter fluid. Therefore, there is a need for non-expensive simple and flexible component flow restriction systems.

The greatest limitation of current devices is that the sleeve or power piston of the device that allows fluid to flow from the casing to a formation (through openings or ports in the apparatus wall) opens immediately after the actuation pressure is reached. This limits the test time at pressure and in many situations precludes the operator from ever reaching the desired casing test pressure. Prior art overcomes that limitation by providing a hydraulic delay to afford adequate time to test the casing at the required pressure and duration before allowing fluid communication with the wellbore and geologic formation. This is accomplished by slowly releasing a trapped volume of fluid through a hydraulic metering chamber that allows piston travel. However, there is a need to provide the time delay with commercially available tubes with a simple mechanism.

Prior Art System Hydraulic Time Delay System (0100)

As generally seen in the system diagram of FIG. 1 (0100), prior art systems associated with hydraulic flow restriction include a flow restriction element (0101). Commercially available flow restriction elements such as the Visco Jet consists basically of three discs mounted one upon the other to form an extremely complex fluid passage. Fluid enters at the center of one disc and passes through a slot which is tangential to a spin chamber. This discharges through a small center hole into another chamber. This process repeats over and over. Since the spinning liquid makes many revolutions in each spin chamber, the resulting fluid resistance uses the flow passage surfaces many times. The tangential nature of the slots overcomes sensitivity to viscosity. The centrifugal force of the liquid maintains a back pressure on the discharge of the slot which is proportional to the square of the RPM of the spinning liquid.

Deficiencies in the Prior Art

The prior art as detailed above suffers from the following deficiencies:

- Prior art systems do not provide large pressure rating time delay flow restriction elements exceeding 5000 PSI.
- Prior art systems do not provide for a low cost configurable time delay flow restriction element that could be commonly available.
- Prior art systems do not provide for a hydraulic/mechanical/energetic shock absorbable time delay element that can withstand shock expected in a downhole wellbore.
- Prior art systems do not provide for a cost effective hydraulic time delay solution that uses time delay elements connected in parallel for time delays exceeding a few hours.
- Prior art systems do not provide for small inner diameter flow restriction elements without reducing the overall inner diameter of a wellbore casing.
- Prior art systems do not provide for controlling time delay in a downhole wellbore with secondary plugging agents in a fluid reservoir.
- Prior art systems do not provide for controlling time delay in a downhole wellbore with porous restriction elements.

While some of the prior art may teach some solutions to several of these problems, the core issue of reacting to unsafe gun pressure has not been addressed by prior art.

BRIEF SUMMARY OF THE INVENTION

System Overview

The present invention in various embodiments addresses one or more of the above objectives in the following manner. The system includes an actuation mechanism which allows pressure to act on a functional piston in the downhole tool. The movement of the piston is restrained by a partially or filled reservoir which is allowed to exhaust through a flow restriction element. The restriction element comprises standard metal tubing with a known inner diameter and is cut to an exact length as predicted by fluid dynamic modeling. A time delay and rate of piston movement desired for the downhole tool, between a trigger event such as pressure and a functional event, can be tuned with parameters that include the length and diameter of the tubing, reservoir fluid viscosity, and number of tubes in parallel. In another embodiment, a secondary plugging element added to the reservoir controls the rate of piston movement and time delay. Alternatively, a porous restriction tube comprising a permeable porous material such as Limestone may be used to achieve a desired time delay.

Method Overview

The present invention system may be utilized in the context of an overall downhole wellbore hydraulic time delay method, wherein the downhole wellbore hydraulic time delay system as previously described is controlled by a method having the following steps:

(1) positioning a wellbore tool at a desired wellbore location;

(2) checking if a differential pressure acted on a piston exceeds a rated pressure;

(3) motioning the piston from a first trigger position into a space of said reservoir; and (4) retarding a rate of travel of the piston from the first trigger position to a second functional position.

Integration of this and other exemplary embodiment methods in conjunction with a variety of exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

OBJECTIVES OF THE INVENTION

Figure 1:
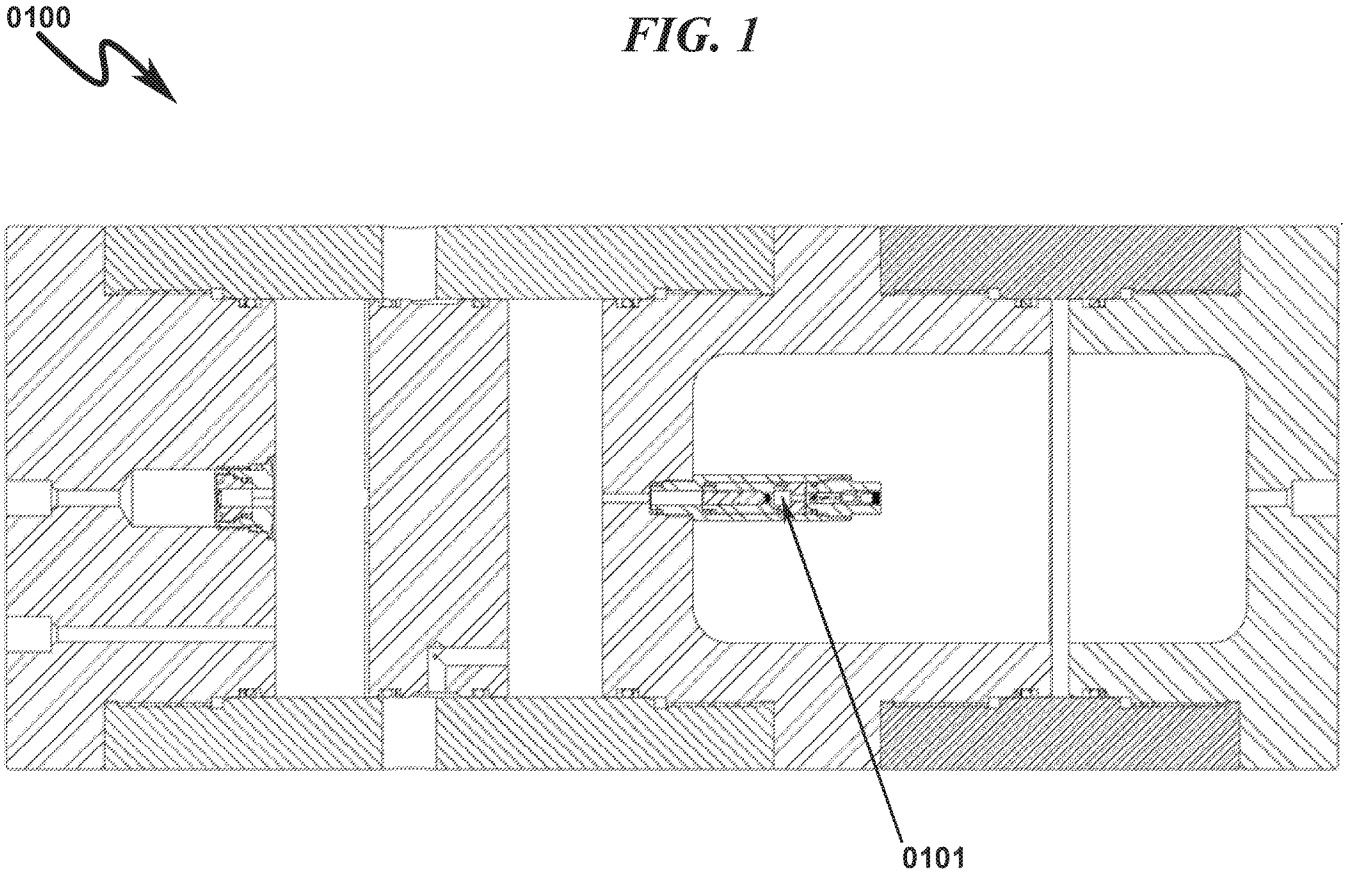
FIG. 1 Prior Art
FIG. 1 illustrates a system cross-section overview diagram describing how prior art systems use restriction flow elements for time delay purposes.

Accordingly, the objectives of the present invention are (among others) to circumvent the deficiencies in the prior art and affect the following objectives:

Provide for large pressure rating time delay flow restriction elements exceeding 5000 PSI.

Provide for a low cost configurable time delay flow restriction element that could be commonly available.

Provide for a hydraulic/mechanical/energetic shock absorbable time delay element that can withstand shock expected in a downhole wellbore.

Provide for a cost effective hydraulic time delay solution that uses time delay elements connected in parallel for time delays exceeding a few hours.

Provide for small inner diameter flow restriction elements without reducing the overall inner diameter of a wellbore casing.

Provide for controlling time delay in a downhole wellbore with secondary plugging agents in a fluid reservoir.

Provide for controlling time delay in a downhole wellbore with porous restriction elements.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

DESCRIPTION OF THE PRESENTLY PREFERRED EXEMPLARY EMBODIMENTS

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a hydraulic time delay system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

Preferred Exemplary System Block Diagram Hydraulic Time Delay Flow Restriction Metal Tube (0200-0600)

Figures 2, 3, 4, 5:
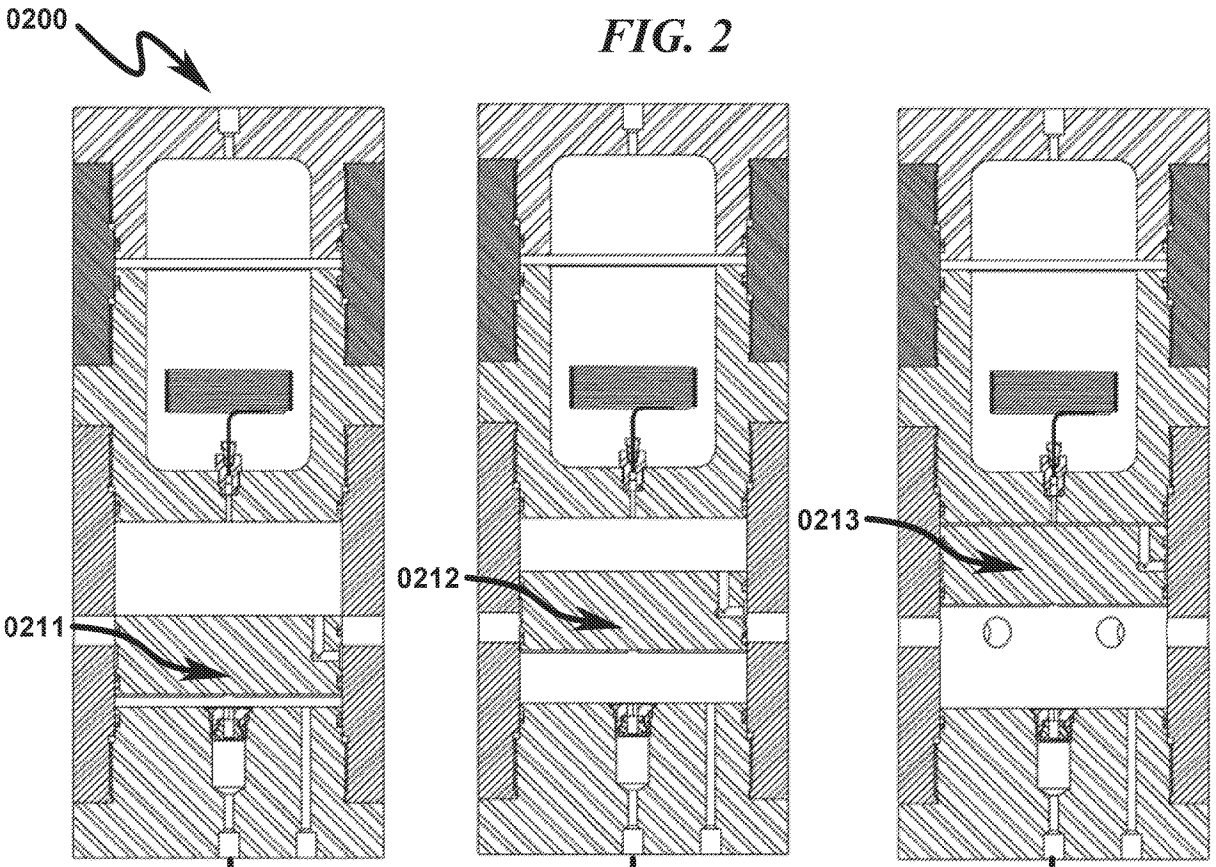
FIG. 2 illustrates a system cross-section overview diagram describing an initial set up, actuation position and a final functional position for a time delay hydraulic flow restriction tube according to a presently exemplary embodiment of the present invention.
FIG. 3 illustrates a system cross-section overview diagram describing an initial set-up for a time delay hydraulic flow restriction tube according to a presently exemplary embodiment of the present invention.
FIG. 4 illustrates a system cross-section overview diagram describing an actuation position for a time delay hydraulic flow restriction tube according to a presently exemplary embodiment of the present invention.
FIG. 5 illustrates a system cross-section overview diagram describing a completed actuation position for a time delay hydraulic flow restriction tube according to a presently exemplary embodiment of the present invention.
Figure 3:
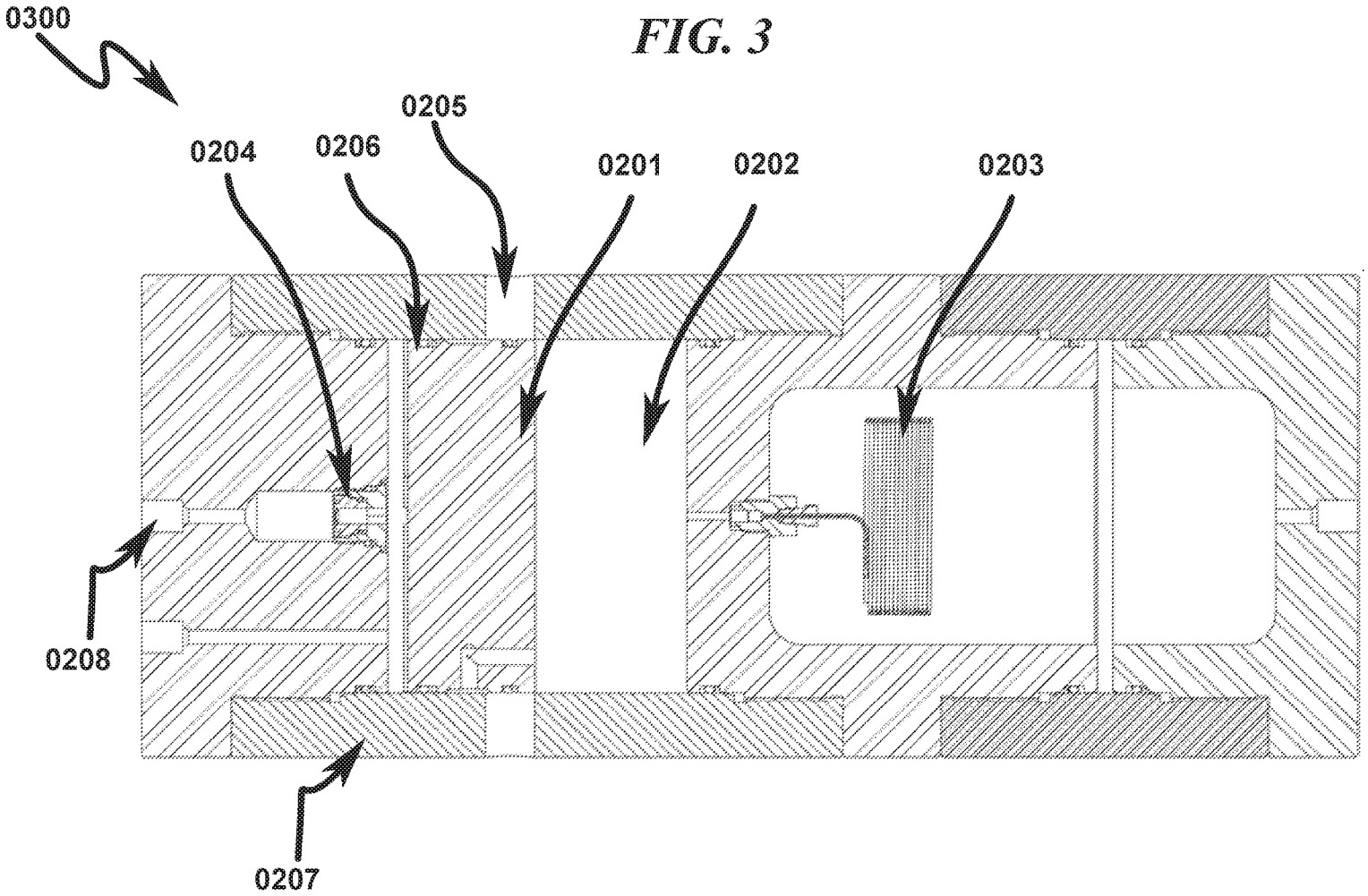
Figure 4:
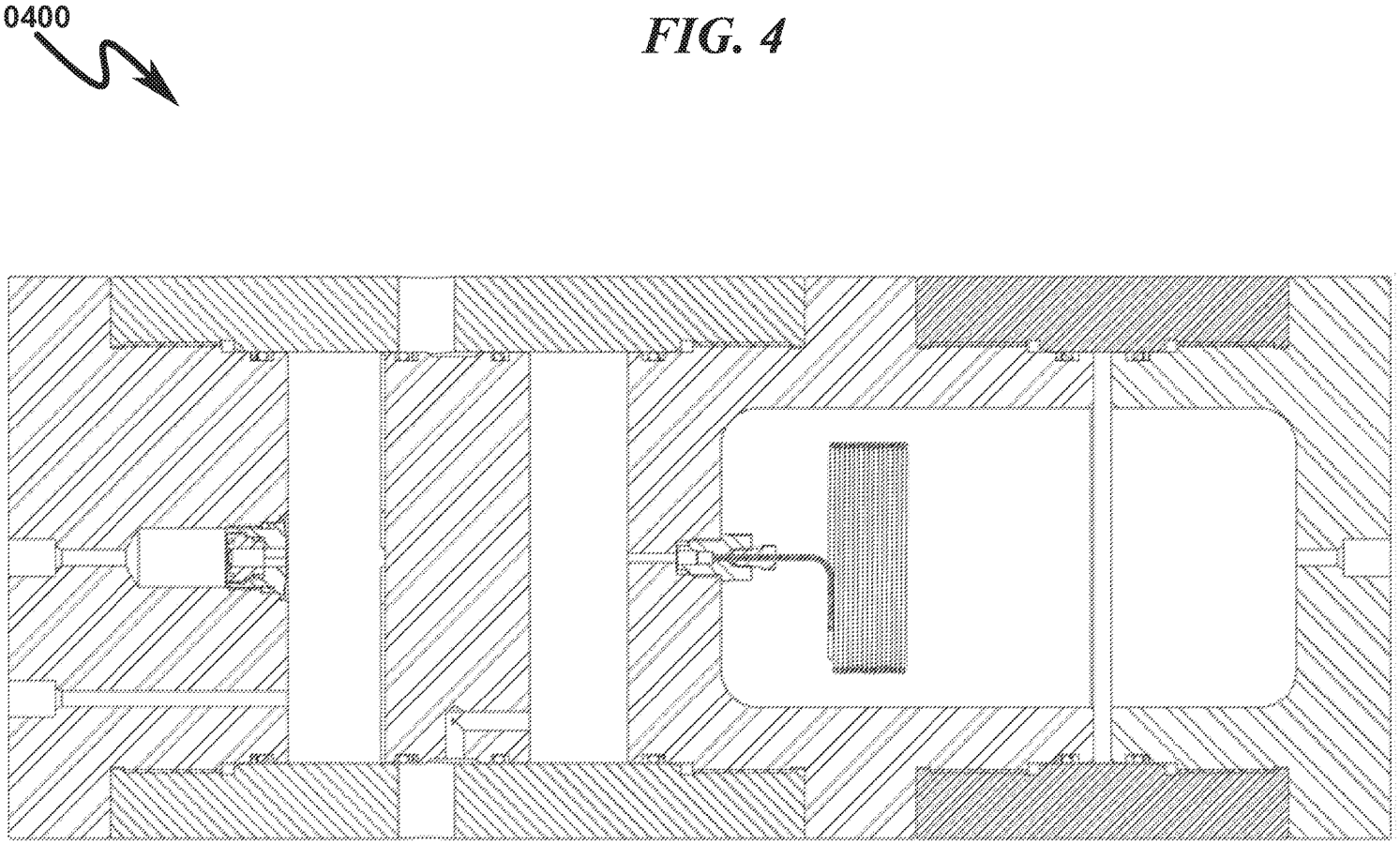
Figures 5, 6:
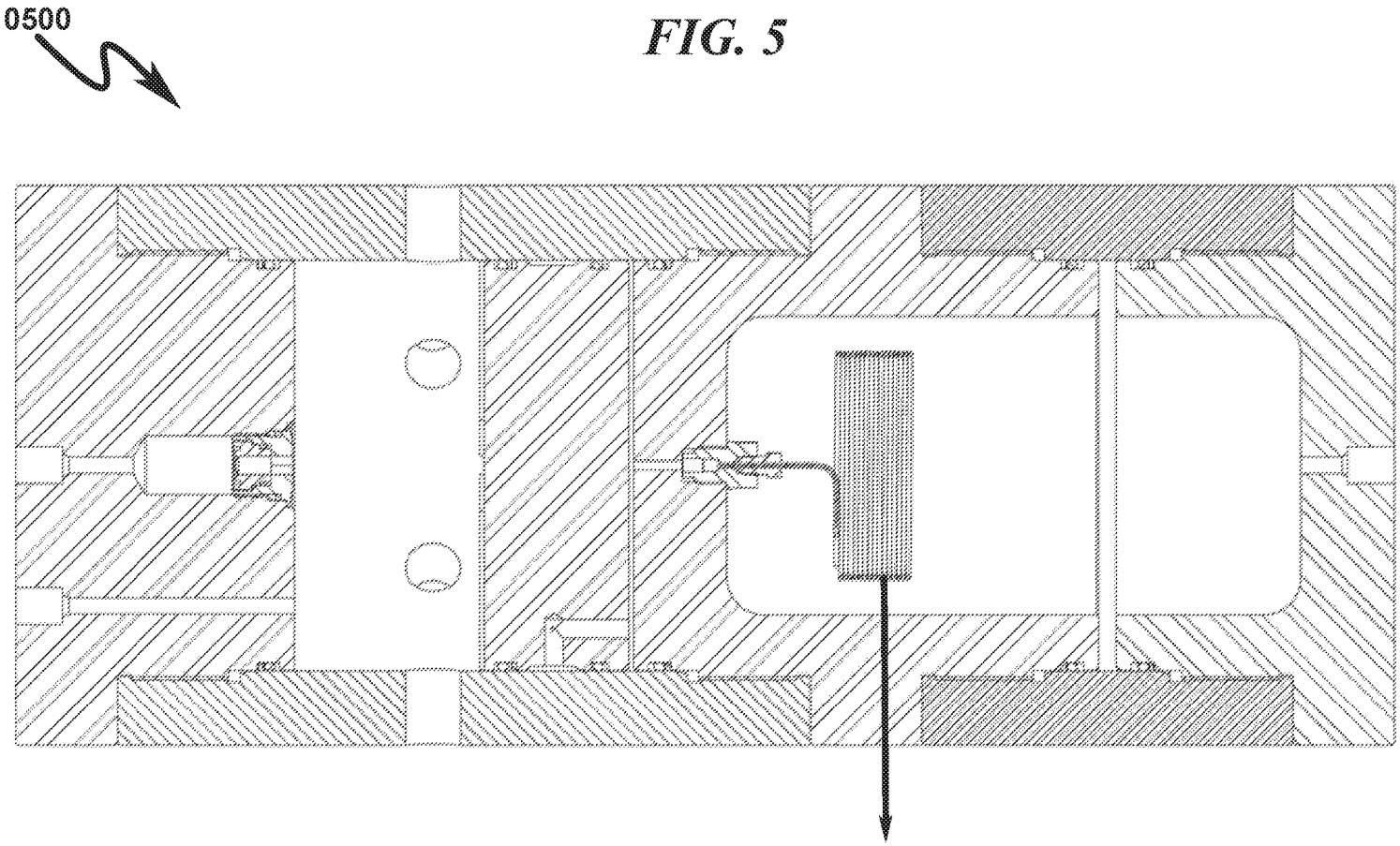
FIG. 6 illustrates an enlarged system cross-section overview diagram of a time delay hydraulic flow restriction tube according to a presently exemplary embodiment of the present invention.
Figure 6:
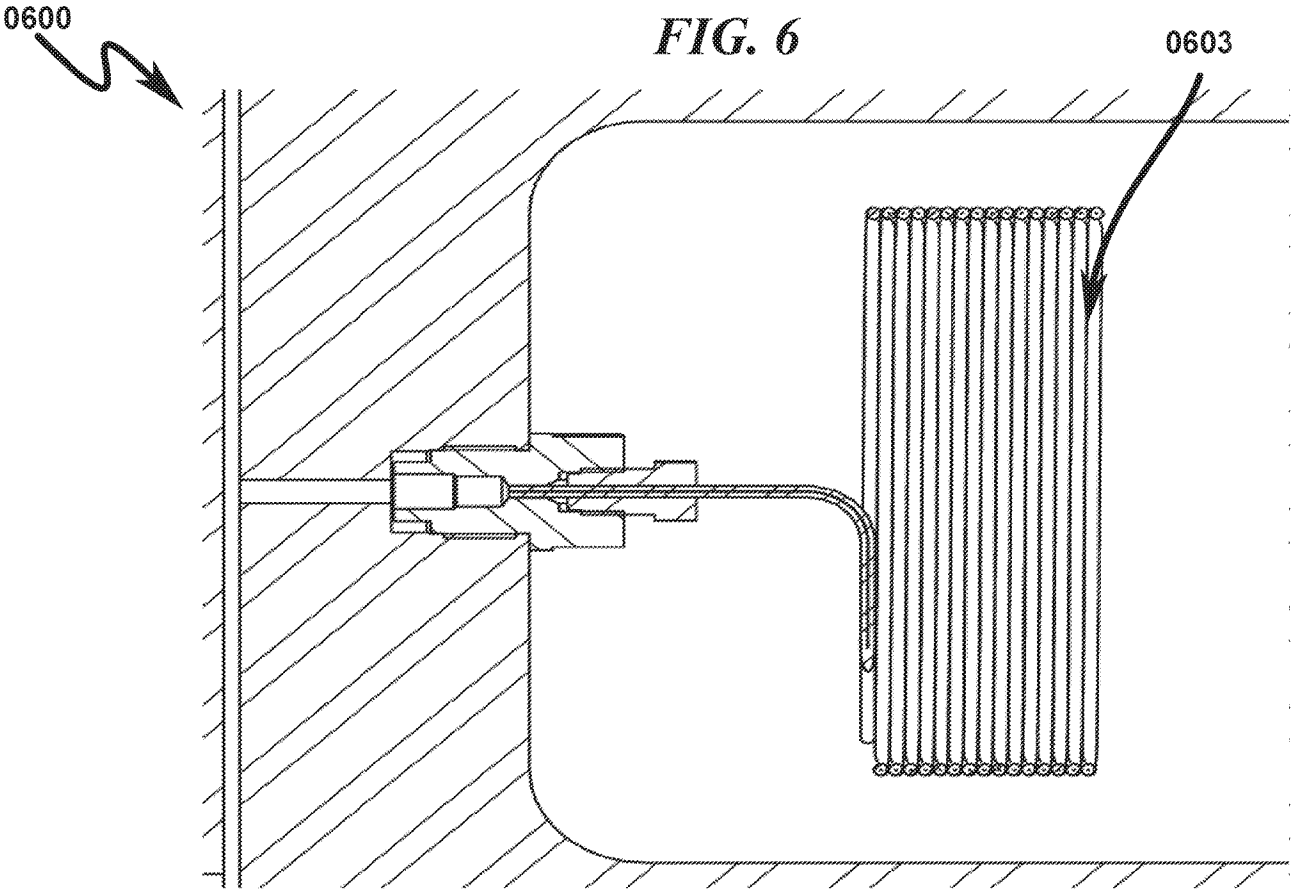

The present invention may be seen in more detail as generally illustrated in FIG. 2 (0200), FIG. 3 (0300), FIG. 4 (0400), FIG. 5 (0500), FIG. 6 (0600), wherein a downhole wellbore tool is deployed inside a wellbore casing. FIG. 2 generally illustrates different positions of a piston (0201) (as shown in FIG. 3) as it moves into an adjacent chamber (0202) (as shown in FIG. 3). The positions include an initial trigger position (0211), an intermediate position (0212) and a final functional position (0213). A detailed view of the tool in the initial trigger position is shown in FIG. 3 (0300), intermediate position is shown in FIG. 4 (0400) and a final functional position is shown in FIG. 5 (0500). The entire tool may be piped into the casing string as an integral part of the string and positioned where functioning of the tool is desired. In one exemplary embodiment, the tool may be a toe valve that is positioned where perforation of a formation and fluid injection into a formation is desired. The tool may be installed in either direction with no change in its function. A functioning piston (0201) that is adjacent to a fluid reservoir ("chamber") (0202) containing a fluid, is at an initial trigger position (0211). The piston (0201) is in fluid communication with the fluid reservoir (0202). The functioning piston (0201) may be sealed by seals such as elastomeric seals (0206). The piston (0201) is held at an initial trigger position (0211) by a pressure activated opening device (0204), such as a rupture disk. The tool mandrel (0207) is machined to accept the opening device (0204) (such as rupture discs) that ultimately controls actuation of the piston (0201). In one embodiment, the rated pressure of the opening device may range from 5000 PSI to 15000 PSI.

When ready to operate, the casing pressure is increased to a test pressure condition ("the trigger condition"). This increased pressure causes a pressure differential to exceed the rating pressure of a pressure opening device (0204) thereby, rupturing the opening device (0204) and fluid at casing pressure (hydrostatic, applied or any combination) enters a chamber immediately below and adjacent to the piston (0201). This entry of fluid causes the piston (0201) to begin moving from an initial trigger position (0211) into the space of fluid chamber (0202).

As fluid pressure further increases through port (0208) it moves piston (0201) into the fluid chamber (0202). The restrained movement of the piston allows a time delay from the time the pressure opening device (0204), is ruptured until the piston moves to a functional position (0213). Hydraulic fluid in the fluid chamber (0202) enters the hydraulic restriction tube retarding a rate of travel of the piston.

According to a preferred exemplary embodiment, a hydraulic flow restriction tube (0203) allows fluid to pass from chamber (0202) to a lower pressure chamber. The flow restriction tube (0203) controls the rate of flow of fluid from chamber (0202) and thereby controls the rate of travel of the piston (0201) as it moves to a fully functional position (0213). It should be noted that the rate of travel of the piston directly affects a time delay between a trigger event and a functional event. The flow restriction tube material may be steel, stainless steel, brass, copper, metal, plastic, PEEK, or polymer. In addition, the flow restriction tube is chosen such that it is resistant to hydraulic, energetic, and mechanical shock from conditions expected in the wellbore.

In one exemplary embodiment, slots/ports (0205) in the wellbore tool act as passageways for fluid from the casing to the formation. FIG. 4 (0400) shows the position of piston during the tool actuation. The position of the piston (0212) is in between an initial trigger position (0211) and a final functional position (0213). Initially, this movement increases pressure in the fluid chamber to a value that closely reflects the hydrostatic plus applied casing pressure. There is considerable predetermined control over the delay time by learned manipulation of the fluid type, fluid volume, initial charging pressure of the low pressure chamber and the variable flow rate through the flow restriction tube (0203). A detailed view of the hydraulic flow restriction tube (0603) is generally illustrated in FIG. 6 (0600). The time delay can be set as desired but generally will be about 5 to 60 minutes.

In one preferred exemplary embodiment, the hydraulic flow restriction tube may be a hollow cylindrical element with an inlet port and an outlet port. The inlet port and outlet port may be shaped as circular, oval, square or a combination thereof. The length of the tube may be varied to achieve a desired time delay. According to a preferred exemplary embodiment, the length of the tube ranges from 0.1 inches to 1000 feet. According to a more preferred exemplary embodiment, the length of the tube ranges from 1 inch to 100 feet. According to a most preferred exemplary embodiment, the length of the tube ranges from 1 inch to 10 feet. One or more hydraulic flow restriction tubes may be operatively connected to one or more hydraulic flow restriction tubes in series or parallel to achieve a desired time delay.

In one preferred exemplary embodiment, the hydraulic flow restriction tube is a capillary tube. The capillary tube may have a small inner diameter, such that the capillary force generated by a fluid passing through it is a first order effect. The hydraulic flow restriction tube (0603) parameters and hydraulic fluid properties may be selected to achieve the desired time delay as described below.

Hydraulic Flow Restriction Tube Time Delay Drivers:

Tube Length:

In one exemplary embodiment, the length of the hydraulic flow restriction tube may be chosen so that a desired time delay is achieved. A longer tube lowers the flow rate of the fluid from the reservoir and thereby increases the time delay. Conversely, a shorter tube increases the flow rate of the fluid from the reservoir and thereby decreases the time delay. For example, a 10 minute time delay may be achieved with a 10 foot tube and a 30 minute time delay may be achieved with a 50 foot tube with all the other factors remaining the same. According to a preferred exemplary embodiment, the length of the tube may vary from 0.01 inches to 50 feet. The inlet port and the outlet port may not be the same as in an orifice. The inlet port and outlet port are at least separated by the length of the tube, the length being greater than the thickness of the tube. An orifice by definition has a single inlet and outlet port, in contrast, the hydraulic flow restriction tube may be a hollow cylindrical structure with a separate inlet port and an outlet port.

Tube Diameter:

In another exemplary embodiment, the inner diameter of the hydraulic flow restriction tube may be chosen so that a desired time delay is achieved. A smaller inner diameter tube lowers the flow rate of the fluid from the reservoir and thereby increases the time delay. Conversely, a larger inner diameter tube increases the flow rate of the fluid from the reservoir and thereby decreases the time delay. For example, a 30 minute time delay may be achieved with a 0.007 inches inner diameter and a 10 minute time delay may be achieved with a 0.01 inch inner diameter with all the other factors remaining the same.

Fluid Viscosity:

The fluid in the reservoir/chamber may be selected to achieve a desired time delay between a trigger event and a functional event. It is known that viscosity is inversely proportional to temperature. A higher viscosity fluid lowers the flow rate of the fluid from the reservoir and thereby increases the time delay. Conversely, lower viscosity fluid increases the flow rate of the fluid from the reservoir and thereby decreases the time delay. Any hydraulic fluid will be suitable if capable of withstanding the pressure and temperature conditions that exist in the wellbore. Those skilled in the art will easily be able to select suitable fluids such as Skydrol 500B-4TM, water, or McDermott fluid.

Number of Tubes:

In one preferred exemplary embodiment, multiple hydraulic flow restriction tubes may be connected in parallel to achieve shorter delays and increased reliability. For example, a single hydraulic flow restriction tube may provide a 10 minute delay versus a 3 minute delay for 3 hydraulic flow restriction tubes connected in parallel.

In a most preferred exemplary embodiment, a 10 minute time delay is attained with a hydraulic restriction metal tube having an inner diameter of 0.007 inches and a length of 10 feet at a 10000 PSI pressure differential and a temperature 200° F. The fluid used in the preferred embodiment may be water or an anti-coagulating, anti-corrosive fluid such as McDermott fluid typically used in a downhole wellbore.

In an alternative most preferred exemplary embodiment, a 30 minute time delay is attained with a hydraulic restriction metal tube having an inner diameter of 0.01 inches and a length of 150 feet, at a 10000 PSI pressure differential and a temperature of 200° F.

Secondary Plugging Agent Exemplary Embodiment:

In yet another preferred exemplary embodiment, a secondary plugging agent may be introduced into the fluid reservoir that plugs a hydraulic restriction metal tube but could be metered. The addition of a secondary agent further retards the rate of travel of the piston, thereby increasing the time delay between a functional event and a trigger event. Larger delays may be possible with a small fluid reservoir with the addition of the secondary plugging agent. For example, a time delay between one hour and 24 hours may be attained with a reservoir having a 1 liter capacity. In a preferred exemplary embodiment, a time delay between 0.01 seconds and 14 days is achieved. In a further preferred exemplary embodiment, a time delay between 2 days and 14 days is achieved. In a most preferred exemplary embodiment, a time delay between 1 hour and 48 hours is achieved. The secondary plugging agent may have particles with different sizes that are less than the inner diameter of the hydraulic restriction metal tube. A larger particle size may be used for a larger time delay. For example if the inner diameter of the tube is 0.007 inches, the particle size may range from 0.0001 inch to 0.010 inches. In a preferred exemplary embodiment the particle size is between 0.0001 inches to 0.01 inches. The particles in the secondary plugging agent may be solid, semi-solid, crystalline, or precipitate at the wellbore temperature. The particles may also be generated from a chemical reaction that causes precipitation at the wellbore temperature.

In a preferred exemplary embodiment, a downhole wellbore tool comprises the hydraulic restriction metal tube for offsetting time delay between a trigger event and a functional event. The downhole tool may be a wellbore setting tool or a perforation tool. The perforation tool may be used in a perforating gun firing head for delaying a perforating event. Similarly, the perforation tool may also be a used for delaying perforating time between perforating guns in a perforating gun string assembly.

In another preferred exemplary embodiment, a downhole wellbore valve comprises the hydraulic restriction metal tube for offsetting time delay between a trigger event and a functional event. The valve may be a downhole formation injection valve.

In yet another preferred exemplary embodiment, an openhole or a cemented hydraulic fracturing valve comprises the hydraulic restriction metal tube for offsetting time delay between a trigger event and a functional event. The time delay to open or close the valve to fracture and perforate may be configured with the restriction metal tube. In a further exemplary embodiment, the cemented hydraulic fracturing valve may be a toe valve that is opened to a hydrocarbon formation after a casing pressure is reached. In this case, the time after reaching the casing pressure (trigger event) and a fracturing (functional event) is delayed to provide sufficient time to check for casing integrity.

In a further preferred exemplary embodiment, the hydraulic flow restriction tube allows for heat incorporation or dissipation as required by the overall tool. As the fluid passes through the system it is more thermally susceptible to the addition or subtraction of thermal energy.

Preferred Exemplary Embodiment Hydraulic Flow Restriction Tube in Conjunction with a Flow Restriction Element In a further preferred exemplary embodiment, the hydraulic flow restriction tube may be mechanically connected in series or parallel to a commercially available flow restriction element such as a ViscoJet. The addition of the hydraulic flow restriction tube provides more delay and reduces mechanical/energetic shock to the flow restriction element.

Preferred Exemplary Flowchart Embodiment of a Time Delay Hydraulic Flow Restriction Tube (0700)

Figure 7:
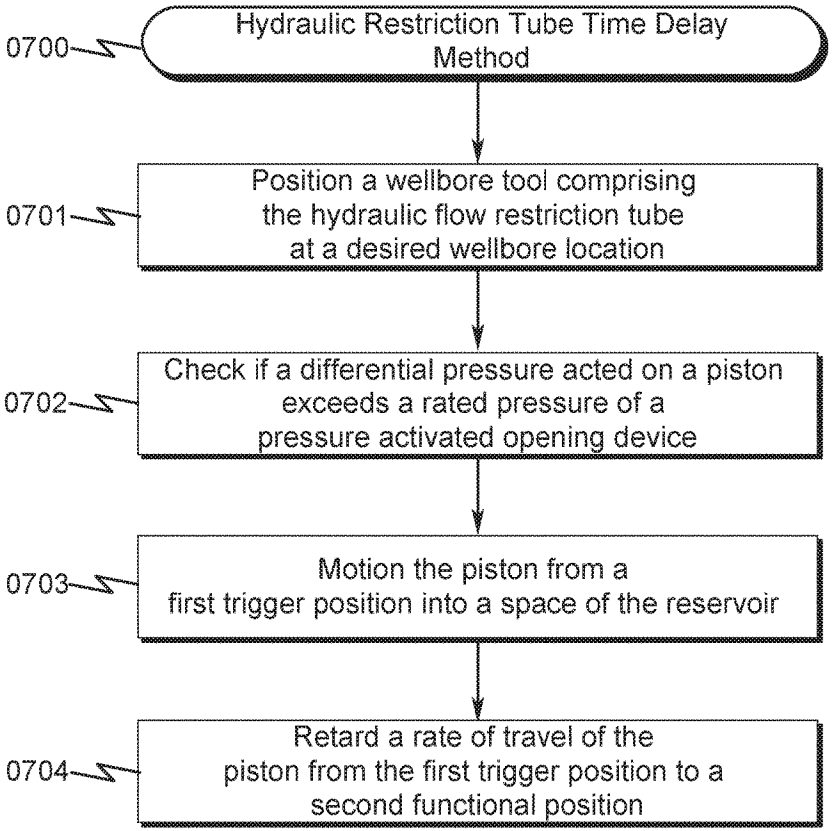
FIG. 7 illustrates an exemplary flow chart for retarding the rate of travel of a functional piston with a hydraulic flow restriction tube deployed in a downhole wellbore according to a presently exemplary embodiment of the present invention.

As generally seen in the flow chart of FIG. 7 (0700), a preferred exemplary flowchart embodiment of a time delay hydraulic flow restriction tube method may be generally described in terms of the following steps:

(1) positioning a wellbore tool comprising the hydraulic flow restriction tube at a desired wellbore location (0701);

The entire tool may be piped into the casing string as an integral part of the string and positioned where functioning of the tool is desired or the tool may be deployed to the desired location using TCP or a wire line. The wellbore may be cemented or not.

(2) checking if a differential pressure acted on a piston exceeds a rated pressure (0702);

If the differential pressure acting on the piston is greater than a rated pressure of a pressure activated opening device, the device ruptures and allows the piston to move. The rating of the pressure activated device could range from 5000 PSI to 15000 PSI.

(3) motioning the piston from a first trigger position into a space of the reservoir (0703); and (4) retarding a rate of travel of the piston from the first trigger position to a second functional position (0704).

Preferred Exemplary Porous Tube Restriction Tube (0800-0900)

Figures 8, 9:
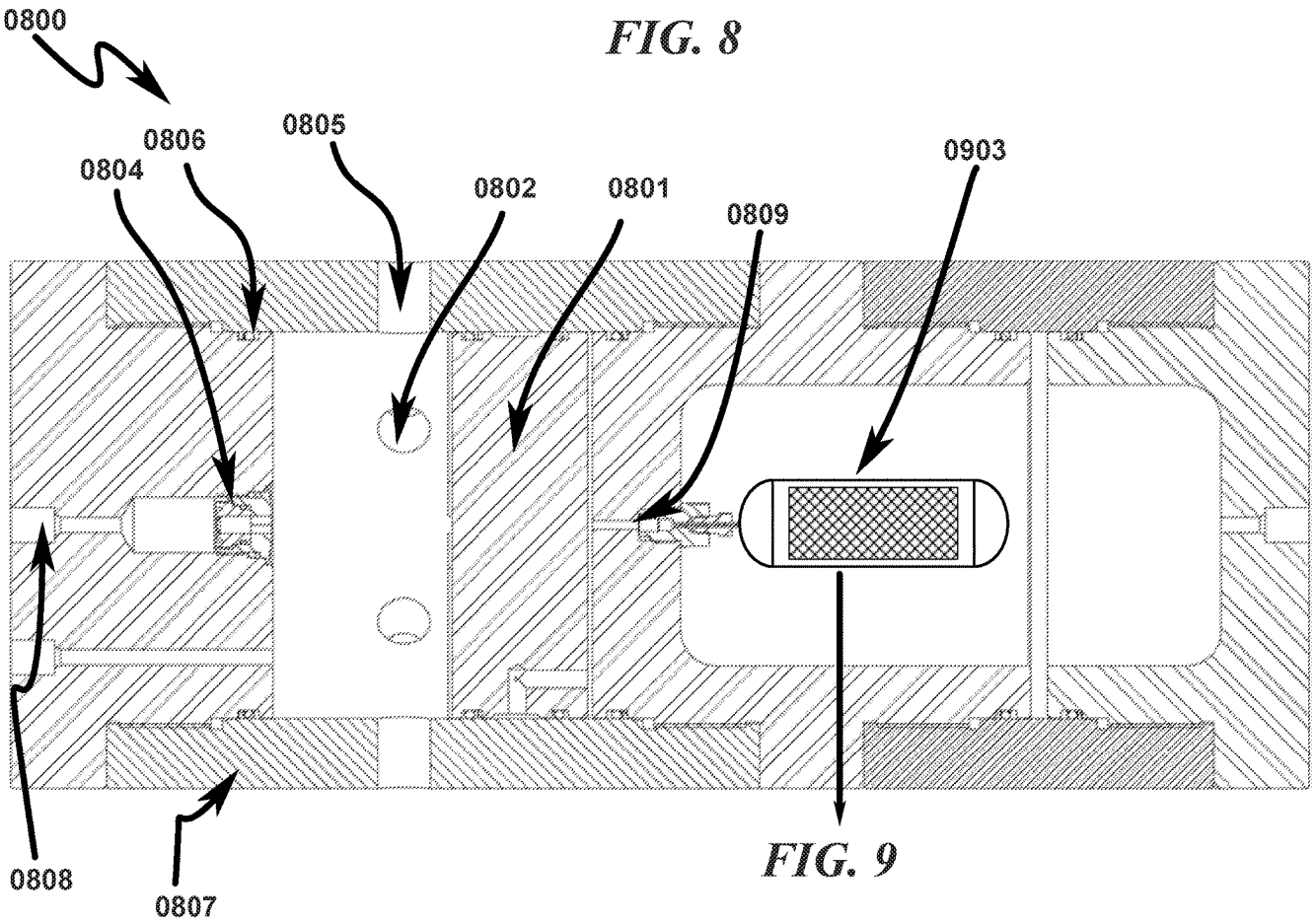
FIG. 8 illustrates a system cross-section overview diagram describing a completed actuation position for a time delay hydraulic flow restriction tube according to a presently exemplary embodiment of the present invention.
FIG. 9 illustrates an enlarged system cross-section overview diagram of a time delay hydraulic flow restriction tube according to a presently exemplary embodiment of the present invention.
Figure 9:
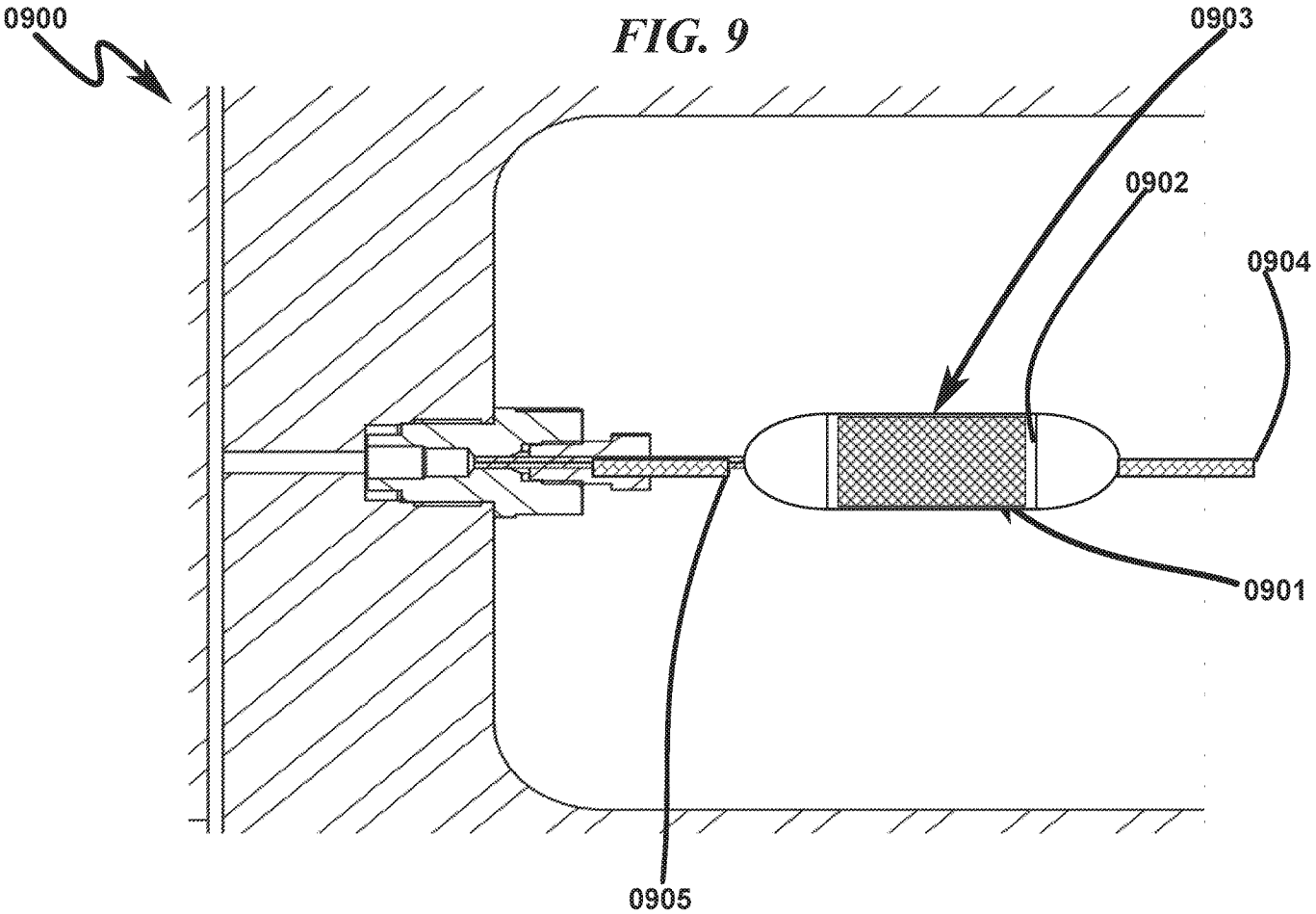

A preferred embodiment is generally illustrated in more detail in FIG. 8 (0800), and FIG. 9 (0900), wherein a downhole wellbore tool is deployed inside a wellbore casing. Similar to the wellbore tool illustrated in FIG. 2, a detailed view of the tool with a porous restriction tube in a final functional position is shown in FIG. 8 (0800). The entire tool may be piped into the casing string as an integral part of the string and positioned where functioning of the tool is desired. A piston (0801) may be in fluid communication with the fluid reservoir (0802). The piston (0801) may be sealed by seals such as elastomeric seals (0806). The piston (0801) is held at an initial trigger position by a pressure activated opening device (0804), such as a rupture disk. The tool mandrel (0807) is machined to accept the opening device (0804) (such as rupture discs) that ultimately controls actuation of the piston (0801).

When ready to operate, the casing pressure is increased to a test pressure condition ("the trigger condition"). This increased pressure causes a pressure differential to exceed the rating pressure of a pressure opening device (0804) thereby, rupturing the opening device (0804) and fluid at casing pressure (hydrostatic, applied or any combination) enters a chamber immediately below and adjacent to the piston (0801). This entry of fluid causes the piston (0801) to begin moving from an initial trigger position into the space of fluid chamber (0802).

As fluid pressure further increases through port (0808) it moves piston (0801) into the fluid chamber (0802). The restrained movement of the piston allows a time delay from the time the pressure opening device (0804) is ruptured until the piston moves to a functional position. Hydraulic fluid in the fluid chamber (0802) enters the porous restriction tube (0903) at inlet port (0905) and exits the porous restriction tube (0903) at outlet port (0904) thereby retarding a rate of travel of the piston. According to a preferred exemplary embodiment, the porous restriction tube may not have an inlet port and an outlet port. The porous restriction tube (0903) illustrated in more detail in FIG. 9 (0900) may comprise an outer sealing material (0902) surrounding a porous material (0901). The porous material (0901) may be selected from a group comprising: Natural Rock, sintered metal, Sand, Fibrous material or combination thereof. The natural rock may be lime stone, sandstone, carbonate, shale or combination thereof. The sand may be bonded with calcite or Resin or any bonding material. The Fibrous material may be cotton or synthetic fiber. According to a preferred exemplary embodiment, the porous material is permeable which permits fluid flow. The permeability of the porous material may be selected to achieve a desired fluid flow and therefore a desired time delay. According to a preferred exemplary embodiment, the time delay ranges from 0.01 seconds to 1 hour. According to another preferred exemplary embodiment, the delay ranges from 1 hour to 48 hours. According to yet another preferred exemplary embodiment, the delay ranges from 2 days to 14 days. According to a further preferred exemplary embodiment, the delay ranges from 0.01 seconds to 14 days.

According to a preferred exemplary embodiment, a porous restriction tube (0903) allows fluid to pass from chamber (0802) to a lower pressure chamber. The flow restriction tube (0903) controls the rate of flow of fluid from chamber (0802) and thereby controls the rate of travel of the piston (0801) as it moves to a fully functional position. It should be noted that the rate of travel of the piston directly affects a time delay between a trigger event and a functional event. The porous restriction tube material may be steel, stainless steel, brass, copper, metal, plastic, PEEK, or polymer. In addition, the flow restriction tube is chosen such that it is resistant to hydraulic, energetic, and mechanical shock from conditions expected in the wellbore.

In a preferred exemplary embodiment, the porous restriction tube may be operatively connected in series or parallel to a commercially available flow restriction element such as a ViscoJet. The addition of the hydraulic flow restriction tube provides more delay and reduces mechanical/energetic shock to the flow restriction element.

In another preferred exemplary embodiment, the porous hydraulic flow restriction tube may be operatively connected in series or parallel to a capillary tube.

In yet another preferred exemplary embodiment, the porous hydraulic flow restriction tube may be operatively connected to a hydraulic flow restriction tube in series or parallel or combination thereof to achieve a desired time delay.

In yet another preferred exemplary embodiment, the porous restriction tubes may be arranged in series or parallel or combination thereof to achieve a desired time delay.

It should be noted that any combination and arrangement of the hydraulic flow restriction tube such as a capillary tube, porous restriction tube, and hydraulic restriction element such as a ViscoJet may be used in series or parallel to achieve a desired and controlled time delay between a trigger event and a functional event.

System Summary

The present invention system anticipates a wide variety of variations in the basic theme of hydraulic time delay, but can be generalized as hydraulic time delay system comprising:

(a) a piston;
(b) a reservoir for containing a hydraulic fluid, the reservoir adjacent to the piston; and
(c) a flow restriction tube in fluid communication with the reservoir; said flow restriction tube having an inlet port and an outlet port;

whereby, when in use, when a pressure differential acting on the piston exceeds a rated pressure, said piston is urged into space of the reservoir, the hydraulic fluid flows into the inlet port and flows out of the outlet port to retard rate of travel of the piston.

This general system summary may be augmented by the various elements described herein to produce a wide variety of invention embodiments consistent with this overall design description.

Alternate System Summary

The present invention system anticipates a wide variety of variations in the basic theme of hydraulic time delay, but can be generalized as a porous hydraulic time delay system, the system comprising:

(a) a piston;
(b) a reservoir for containing a hydraulic fluid, the reservoir adjacent to the piston; and
(c) a porous flow restriction tube in fluid communication with the reservoir; the porous flow restriction tube packed with a porous material;

whereby, when in use, when a pressure differential acting on the piston exceeds a rated pressure, the piston is urged into space of the reservoir, the hydraulic fluid flows into the porous restriction tube to retard a rate of travel of the piston.

This general system summary may be augmented by the various elements described herein to produce a wide variety of invention embodiments consistent with this overall design description.

Method Summary

The present invention method anticipates a wide variety of variations in the basic theme of implementation, but can be generalized as a hydraulic flow restriction tube method wherein the method is performed on hydraulic flow restriction tube comprising:

(a) a piston;
(b) a reservoir for containing a hydraulic fluid, the reservoir adjacent to the piston; and
(c) a flow restriction tube in fluid communication with the reservoir; said flow restriction tube having an inlet port and an outlet port;

wherein the method comprises the steps of:

(1) positioning a wellbore tool at a desired wellbore location;
(2) checking if a differential pressure acted on a piston exceeds a rated pressure;
(3) motioning the piston from a first trigger position into a space of said reservoir; and
(4) retarding a rate of travel of the piston from the first trigger position to a second functional position.

This general method summary may be augmented by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein the flow restriction tube is a porous restriction tube; the porous restriction tube further comprises a porous material.

An embodiment wherein the porous material is permeable.

An embodiment wherein the porous material is selected from a group comprising: Natural Rock, Sintered metal, Sand, or Fibrous material.

An embodiment wherein the porous restriction tube is further coupled to a restriction element; the restriction element configured to further retard the rate of travel.

An embodiment wherein a shape of the inlet port and the outlet port is selected from a group comprising: circle, oval or square.

An embodiment wherein the piston starts movement to a second functional position when the pressure differential exceeds the rated pressure of a pressure opening device; the pressure opening device mechanically coupled to the piston.

An embodiment wherein the piston is at a first trigger position when the pressure differential is less than the rated pressure of a pressure opening device; the pressure opening device mechanically coupled to the piston.

An embodiment wherein the flow restriction tube is a capillary tube.

An embodiment wherein the flow restriction tube length is at least 0.01 inches.

An embodiment wherein the delay ranges from 0.01 seconds to 1 hour.

An embodiment wherein the delay ranges from 1 hour to 48 hours.

An embodiment wherein the delay ranges from 2 days to 14 days.

An embodiment wherein the delay ranges from 0.01 seconds to 14 days.

An embodiment wherein the pressure differential is at least 5000 PSI.

One skilled in the art will recognize that other embodiments are possible based on combinations of elements taught within the above invention description.

CONCLUSION

A hydraulic time delay system and method in a wellbore tool has been disclosed. The system/method includes an actuation mechanism which allows pressure to act on a functional piston in the wellbore tool. The movement of the piston is restrained by a partially or filled reservoir which is allowed to exhaust through a flow restriction element. The restriction element comprises standard metal tubing with a known inner diameter and is cut to an exact length as predicted by fluid dynamic modeling. A time delay and rate of piston movement desired for the downhole tool, between a trigger event such as pressure and a functional event, can be tuned with parameters that include the length and diameter of the tubing, reservoir fluid viscosity, porous material with permeability in the tube, and number of tubes in parallel.

What is claimed is:

1. A hydraulic time delay system for use in a downhole wellbore tool;

the system conveyed on a wellbore casing, the system comprising:

a piston;

a reservoir for containing a hydraulic fluid, the reservoir adjacent to the piston;

a low pressure chamber located downstream of the piston;

a porous restriction tube disposed in the low pressure chamber, the porous restriction tube in fluid communication with the reservoir; the porous restriction tube further comprises a porous material; and a flow restriction element coupled to the porous restriction tube;

whereby, when in use, when a pressure differential acting on the piston exceeds a rated pressure, the piston is urged into a space of the reservoir, the hydraulic fluid flows into the porous restriction tube and the flow restriction element to retard a rate of travel of the piston.

2. The hydraulic time delay system of claim 1 wherein said porous material is permeable.

3. The hydraulic time delay system of claim 1 wherein said porous material is selected from a group consisting of: Natural Rock, Sintered metal, Sand, or Fibrous material.

4. The hydraulic time delay system of claim 1 wherein a shape of said inlet port and said outlet port is selected from a group comprising: circle, oval or square.

5. The hydraulic time delay system of claim 1 wherein said piston starts movement to a second functional position when said pressure differential exceeds said rated pressure of a pressure opening device; said pressure opening device mechanically coupled to said piston.

6. The hydraulic time delay system of claim 1 wherein said piston is at a first trigger position when said pressure differential is less than said rated pressure of a pressure opening device; said pressure opening device mechanically coupled to said piston.

7. The hydraulic time delay system of claim 1 wherein said porous restriction tube is connected in series to a capillary tube.

8. The hydraulic time delay system of claim 1 wherein said porous restriction tube length is at least 0.01 inches.

9. The hydraulic time delay system of claim 1 wherein said delay ranges from 0.01 seconds to 1 hour.

10. The hydraulic time delay system of claim 1 wherein said delay ranges from 1 hour to 48 hours.

11. The hydraulic time delay system of claim 1 wherein said delay ranges from 2 days to 14 days.

12. The hydraulic time delay system of claim 1 wherein said delay ranges from 0.01 seconds to 14 days.

13. The hydraulic time delay system of claim 1 wherein said pressure differential is at least 5000 PSI.

14. The hydraulic time delay system of claim 1 wherein the porous restriction tube is connected in parallel with a capillary tube.

15. A hydraulic time delay method wherein said method comprises the steps of:

providing a hydraulic time delay system comprising a piston, a reservoir containing a hydraulic fluid, the reservoir adjacent to the piston, a low pressure chamber located downstream of the piston, and a porous restriction tube disposed in the low pressure chamber, the porous restriction tube in fluid communication with the reservoir, the porous restriction tube further comprising a porous material, and a flow restriction element coupled to the porous restriction tube;

conveying the hydraulic time delay system to a desired wellbore location;

applying a differential pressure on the piston exceeding a rated pressure;

motioning the piston from a first trigger position into a space of the reservoir; and retarding a rate of travel of said piston from said first trigger position to a second functional position.

16. The hydraulic time delay method of claim 15 wherein said step of motioning further comprises said hydraulic fluid flowing into said inlet port and flowing out of said outlet port.

17. The hydraulic time delay method of claim 15 wherein said porous material is permeable.

18. The hydraulic time delay method of claim 15 wherein said porous material is selected from a group consisting of: Natural Rock, Sintered metal, Sand, or Fibrous material.

19. The hydraulic time delay method of claim 15 wherein the step of conveying the hydraulic time delay system to a desired wellbore location further comprises conveying the hydraulic time delay system on a wellbore casing.

20. A porous hydraulic time delay system for use in a downhole wellbore tool, the system comprising:

a piston;

a reservoir for containing a hydraulic fluid, the reservoir adjacent to the piston;

a low pressure chamber located downstream of the piston;

a porous flow restriction tube disposed in the low pressure chamber, the porous restriction tube in fluid communication with the reservoir; said porous flow restriction tube packed with a porous material;

whereby, when in use, when a pressure differential acting on the piston exceeds a rated pressure, the piston is urged into a space of the reservoir, the hydraulic fluid flows into the porous restriction tube to retard a rate of travel of the piston.

21. The porous hydraulic time delay system of claim 20 wherein said porous material is permeable.

22. The porous hydraulic time delay system of claim 20 wherein said porous material is selected from a group consisting of: Natural Rock, Sintered metal, Sand, or Fibrous material.

23. The porous hydraulic time delay system of claim 20 wherein said porous restriction tube is further coupled to a restriction element; said restriction element configured to further retard said rate of travel.

24. The porous hydraulic time delay system of claim 20 wherein the hydraulic time delay system is conveyed on a wellbore casing.

25. A downhole wellbore tool, comprising a hydraulic time delay system, said system comprising:

a piston;

a reservoir for containing a hydraulic fluid, the reservoir adjacent to the piston;

a low pressure chamber located downstream of the piston;

said hydraulic fluid comprising secondary plugging agents; and a porous restriction tube disposed in the low pressure chamber, the porous restriction tube in fluid communication with the reservoir;

whereby, when in use, when a pressure differential acting on the piston exceeds a rated pressure, the piston is urged into space of said reservoir, the hydraulic fluid along with the plugging agents flows into the porous restriction tube to retard rate of travel of the piston.

26. A downhole wellbore tool, comprising a hydraulic time delay system, said system comprising:

a piston;

a reservoir for containing a hydraulic fluid, the reservoir adjacent to said piston;

a low pressure chamber located downstream of the piston;

a porous restriction tube disposed in the low pressure chamber, the porous restriction tube comprising a plurality of tubes connected in parallel;

the porous restriction tube in fluid communication with said reservoir;

whereby, when in use, when a pressure differential acting on said piston exceeds a rated pressure, said piston is urged into space of said reservoir, said hydraulic fluid flows through said plurality of tubes in said porous restriction tube to retard rate of travel of said piston.

* * * * *